US005111908A

United States Patent [19]

Reiter et al.

[11] Patent Number: 5,111,908

[45] Date of Patent: May 12, 1992

[54] PIPE STEP

[75] Inventors: John T. Reiter, Ingleside; David M. Ellis; Rick D. Smith, both of Corpus Christi; Roger D. Leach, Portland, all of Tex.

[73] Assignee: Atlantic Richfield Company, Los Angeles, Calif.

[21] Appl. No.: 770,400

[22] Filed: Oct. 3, 1991

[51] Int. Cl.[5] ..... E06C 7/08

[52] U.S. Cl. ..... 182/92; 182/228; 182/120; 182/46

[58] Field of Search ..... 182/90, 91, 92, 228, 182/82, 46

[56] References Cited

U.S. PATENT DOCUMENTS

| | | | |
|---|---|---|---|
| 1,285,817 | 11/1918 | Sklar | 182/120 |
| 2,103,603 | 12/1937 | Voigt | 182/120 |
| 4,056,270 | 11/1977 | Greenfield | 182/92 |
| 4,102,432 | 7/1978 | Bustin | 182/92 |
| 4,161,232 | 7/1979 | Bustin | 182/92 |

*Primary Examiner*—Reinaldo P. Machado
*Attorney, Agent, or Firm*—A. C. Metrailer

[57] ABSTRACT

A pipe step for providing a flat supporting surface on the top side of a horizontal pipe. The step includes a pair of channel members each having arcs cut in the flange portions thereof to meet with the pipe. U-bolts are provided for clamping the channel members to the pipe. A flat-supporting surface form from square mesh grating is bolted to and extends between the upper web portions of the channel members and provides a non-slip flat supporting surface.

3 Claims, 1 Drawing Sheet

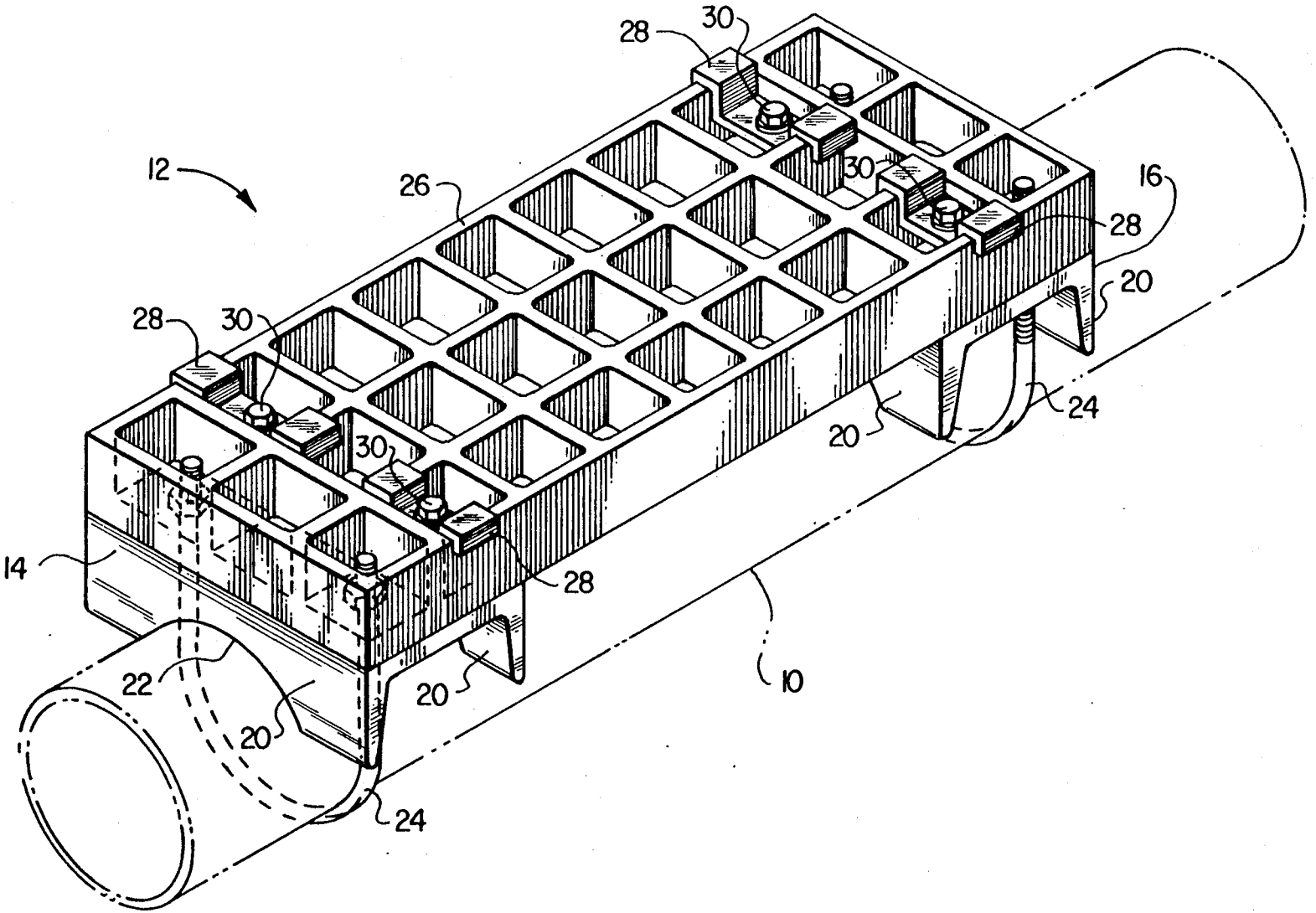
16
28
20
24
30
20
10
30
28
28
26
20
24
30
30
20
12
28
22
14

PIPE STEP

BACKGROUND OF THE INVENTION

The present invention relates to means for providing generally flat supporting surface for standing on the top of horizontal pipes.

Oil and gas production facilities contain many meters and gauges which need to be checked or read on a regular basis and valves which need to be adjusted from time to time. Many of these gauges and valves are positioned so that they are not readily accessible from the standard catwalks, portable ladders, or other floor surfaces. Quite often these devices can be easily reached by standing on horizontal pipes forming parts of the production facility. However, standing on such horizontal pipe is usually contrary to normal operating procedures since their shape and surface texture do not provide a stable support.

SUMMARY OF THE INVENTION

The present invention provides a flat, stable supporting surface which may be easily and quickly clamped to a horizontal pipe. The pipe step of the present invention comprises a pair of short channel iron piece having arcs cut into the flanges thereof, each having the same radius as the pipe. A section of grating is cut to fit on and extend between the web portions of the channel iron sections and is bolted thereto. U-bolts are also connected to the web portions of the channel iron in alignment with the channel iron flange arc cuts to allow the channel iron pieces to be clamped to the pipe in question. The resulting pipe step provides a non-slip flat surface on top of the horizontal pipe.

DESCRIPTION OF THE DRAWINGS

The present invention may be better understood by reading the following detailed description of the preferred embodiment with reference to the accompanying single figure which is a perspective view of a pipe step according to the present invention.

DESCRIPTION OF THE PREFERRED EMBODIMENTS

With reference now to the figure, there is provided a perspective illustration of a pipe step according to the present invention. In the figure, a generally horizontal section of pipe 10 is illustrated in phantom. The pipe step of the present invention is generally illustrated at 12 positioned on top of pipe section 10. Pipe step 12 includes a pair of short pieces of channel iron 14 and 16. Each channel iron piece includes web portions 18 and flange portions 20. In each flange portion 20, there is cut an arc 22 having a diameter corresponding to that of the outer surface of pipe 10, which in this preferred embodiment is two inches. The arcs 22 in all four flanges 20 are in alignment to provide for mating with the top surface of pipe 10. A pair of galvanized U-bolts 24 having diameters corresponding to pipe 10 are attached to the web sections 18 in order to clamp channel iron pieces 14 and 16 to the pipe 10. Each web section 18 is provided with a pair of holes for bolting U-bolts 20 thereto.

The upper step surface is formed from a section of one and one-half inch by one and one-half inch square mesh fiberglass grating of a width corresponding to the length of channel iron sections 14 and 16 and a length selected to provide a convenient standing surface in the preferred embodiment of about 14 inches. The grating 26 is bolted to the web portions 18 by means of clamps 28 and bolts 30 which extend through holes in the width sections 18.

To ensure that the pipe step is tightly clamped to the pipe 10, the U-bolt should be tightened sufficiently to cause deflection in the web portion 18 of each of the iron channel sections 14 and 16. The pipe step 12 may be installed permanently if desired. However, due to the simplicity and ease of the attachment, the pipe step 12 may be installed only temporarily on an as-needed basis. The pipe step 12 may be easily adapted to other pipe sizes simply by changing the radius of cut 22 in flange portions 20 and the diameter of U-bolts 24. The length and width of grating section 26 may likewise be changed as is convenient or appropriate in the particular case. Other materials may also be substituted as appropriate. For instance, iron grating could be used in place of the fiberglass grating 26.

While the present invention has been described and claimed in terms of particular apparatus and material, changes may be made therein within the scope of the appended claims.

What is claimed is:

1. A pipe step for providing a generally flat supporting surface on the upper surface of a generally horizontal pipe of preselected diameter comprising:

a pair of channel members each having a web portion and a pair of flange portions, each flange portion having a transverse arc of diameter corresponding to said pipe diameter cut therein, a rectangular section of grating fastened to and extending between the web portions of said channel members, a pair of U-bolts of diameter corresponding to said pipe diameter, each fastened to the web portion of one of said channel members between the flange portions thereof and in alignment with transverse arcs cut in said flange portions.

2. A pipe step according to claim 1 wherein said channel members ar steel.

3. A pipe step according to claim 1 wherein said grating section is of square mesh fiberglass

* * * * *